US008712092B2

(12) United States Patent
Wei

(10) Patent No.: US 8,712,092 B2
(45) Date of Patent: Apr. 29, 2014

(54) MAGNETIC CIRCUIT AND SPEAKER USING SAME

(75) Inventor: Suo-He Wei, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 177 days.

(21) Appl. No.: 13/189,533

(22) Filed: Jul. 24, 2011

(65) Prior Publication Data

US 2012/0051580 A1 Mar. 1, 2012

(30) Foreign Application Priority Data

Sep. 1, 2010 (CN) ..... 2010 2 0512995 U

(51) Int. Cl.
*H04R 1/00* (2006.01)

(52) U.S. Cl.
USPC ..... 381/398; 381/412

(58) Field of Classification Search
USPC ..... 381/400, 396, 412, 419, 420, 423, 431, 381/421; 335/306
See application file for complete search history.

(56) References Cited

U.S. PATENT DOCUMENTS

| | | | | |
|---|---|---|---|---|
| 6,934,402 | B2 * | 8/2005 | Croft, III et al. | 381/412 |
| 7,062,061 | B2 * | 6/2006 | Suzuki | 381/409 |
| 2009/0034751 | A1 * | 2/2009 | Takewa | 381/86 |
| 2011/0150264 | A1 * | 6/2011 | Konuma | 381/398 |

* cited by examiner

*Primary Examiner* — Duc Nguyen
*Assistant Examiner* — Taunya McCarty
(74) *Attorney, Agent, or Firm* — Anova Law Group, PLLC

(57) ABSTRACT

The present invention provides a magnet assembly and speaker including such a magnet assembly. The magnet assembly includes an outer magnet defining a pair of first plat magnets, an inner magnet surrounded by the outer magnet and defining a pair of second plat magnets, a first magnetic gap formed between an inner surface of the outer magnet and an outer surface of the inner magnet, and a magnetic conductive portion sandwiched between the pair of the second plat magnets. A width of the magnetic conductive portion is unequal to a length of the outer and inner magnets. Polarity of the pair of the first plate magnets adjacent to the magnetic gap is similar to each other. Polarity of the pair of the first plate magnets adjacent to the magnetic gap are opposite to that of the pair of the second plate magnets adjacent to the first magnetic gap.

10 Claims, 4 Drawing Sheets

MAGNETIC CIRCUIT AND SPEAKER USING SAME

FIELD OF THE INVENTION

The present invention generally relates to the art of electromagnetic transducers and, more particularly, to a magnet assembly of a speaker.

DESCRIPTION OF RELATED ART

Speakers are widely applied in mobile devices, such as mobile phones, for converting electrical signals to audible sounds. Generally, a speaker includes a magnet assembly and a coil. The magnet assembly includes a yoke, a magnet fixed on the yoke, a pole plate mounted on an upper surface of the magnet, and a magnetic gap is formed between an inner surface of the yoke and an outer surface of the magnet for partially receiving the coil. The yoke defines a bottom portion for fixing the magnet and a plurality of sidewalls extending from the bottom portion. The magnet defines its own N-pole and S-pole. In the following descriptions, N-pole is called as a first pole and S-pole is called as a second pole. A line connecting the first pole and the second pole is perpendicular to the bottom portion of the yoke. The yoke and the pole plate are made of magnetic conductive materials, so that closed magnetic fluxes are generated from the first pole and conducted by the yoke and the pole plate to enter the second pole.

The pole plate increases the height of the magnetic circuit.

The present invention is provided to solve the problem mentioned above.

DETAILED DESCRIPTION OF THE EXEMPLARY EMBODIMENT

Figure 1:
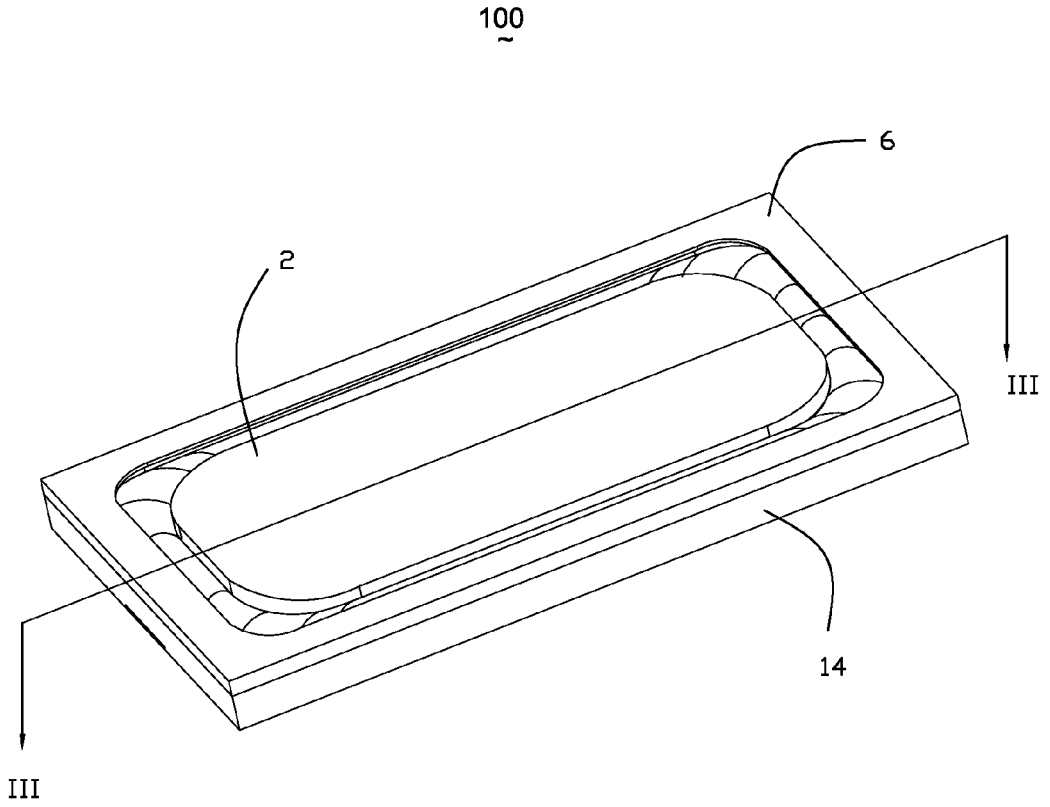
FIG. 1 is an illustrative assembled view of a speaker in accordance with an exemplary embodiment of the present invention.

Reference will now be made to describe the exemplary embodiment of the present invention in detail.

Referring to FIGS. 1 to 4, a speaker 100 comprises a magnet assembly (no labeled) for forming magnetic fluxes 11, a diaphragm 2, a frame 6 attached on the magnet assembly for fixing the diaphragm 2 on the magnet assembly, and a coil 3 attached to the diaphragm 2 for driving the diaphragm 2. The magnet assembly comprises a yoke 14, an outer magnet 12 surrounded and fixed by the yoke 14, an inner magnet 13 at least partially surrounded by the outer magnet 12, and a first magnetic gap 15 formed between an inner surface of the outer magnet 12 and an outer surface of the inner magnet 13. The outer magnet 12 defines a first magnet 121 and a second magnet 122 having the same structure as the first magnet 121. The inner magnet 13 defines a third magnet 131 and a fourth magnet 132 having the same structure as the third magnet 131. The speaker 100 further defines a magnetic conductive portion 4 sandwiched between the third and fourth magnets 131 and 132 and a plate 5 attached on the yoke 14 for supporting the inner magnet 13 and the magnetic conductive portion 4.

The yoke 14, substantially rectangular parallelepiped shaped, is made of magnetic conductive material. The yoke 14 defines a pair of first sidewalls 142, a pair of second sidewalls 141 for abutting against an outer peripheral surface of the outer magnet 12 and connecting with the pair of first sidewalls 142, a fixing portion 143 perpendicularly extending from one end of the sidewalls toward a center of the yoke 14 for abutting against a part of an upper surface of the outer magnet 12, a pair of projecting portions 144 extending from a center of the pair of first sidewalls 142 towards the center of the yoke 14, and a pair of receiving portions 145 extending from a lower surface of the pair of first sidewalls 142. The pair of second sidewalls 141 is opposite to each other and the pair of first sidewalls 142 is also opposite to each other. Each part of each first sidewall 142 abuts against an outer surface of the outer magnet 12. The pair of projecting portions 144 is opposite to the magnetic conductive portion 4, thereby defining a second magnetic gap 16 for receiving the coil 3. The receiving portions 145 are arranged on the center of the pair of first sidewalls 142 for engaging with the plate 5.

The first magnet 121 defines a first pole 1211 and a second pole 1212. A polarity of the second pole 1212 is opposite to that of the first pole 1211. The second magnet 122 defines a third pole 1221 and a fourth pole 1222. A polarity of the third pole 1221 is similar to that of the first pole 1211. A polarity of the third pole 1221 is opposite to that of the fourth pole 1222.

The third magnet 131 defines a fifth pole 1311 and a sixth pole 1312. A polarity of the sixth pole 1312 is opposite to that of the fifth pole 1311. A polarity of the fifth pole 1311 is opposite to the second pole 1212. The fourth magnet 132 defines a seventh pole 1321 and an eighth pole 1322. A polarity of the seventh pole 1321 is similar to that of the fifth pole 1311. A polarity of the eighth pole 1322 is opposite to the seventh pole 1321.

Each of the magnets 121, 122, 131, 132 has its own N-pole and S-pole. In the following descriptions, the first pole 1211 is magnetized as S-pole while the second pole 1212 is magnetized as N-pole. In the same token, the third pole 1221 is magnetized as S-pole while the fourth pole 1222 is magnetized as N-pole. The fifth pole 1311 is magnetized as S-pole while the sixth pole 1312 is magnetized as N-pole. The seventh pole 1321 is magnetized as S-pole while the eighth pole 1322 is magnetized as N-pole. The polarity setting for these magnets 121, 122, 131, 132 is not limited to the above-described arrangements, but the N- and S-arrangements may be reversed with respect to the whole magnets.

Figure 2:
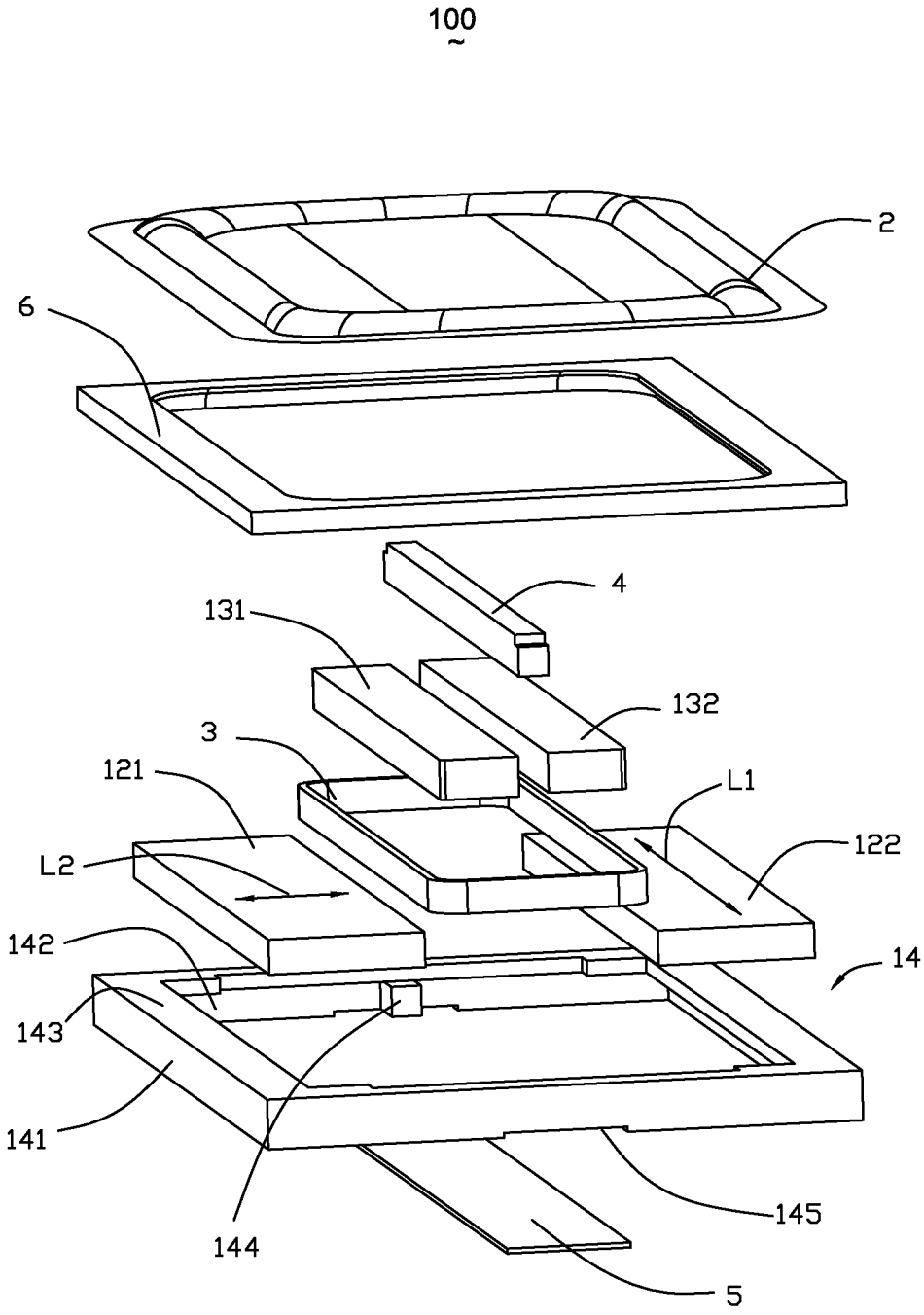
FIG. 2 is an exploded view of the speaker.
Figure 3:
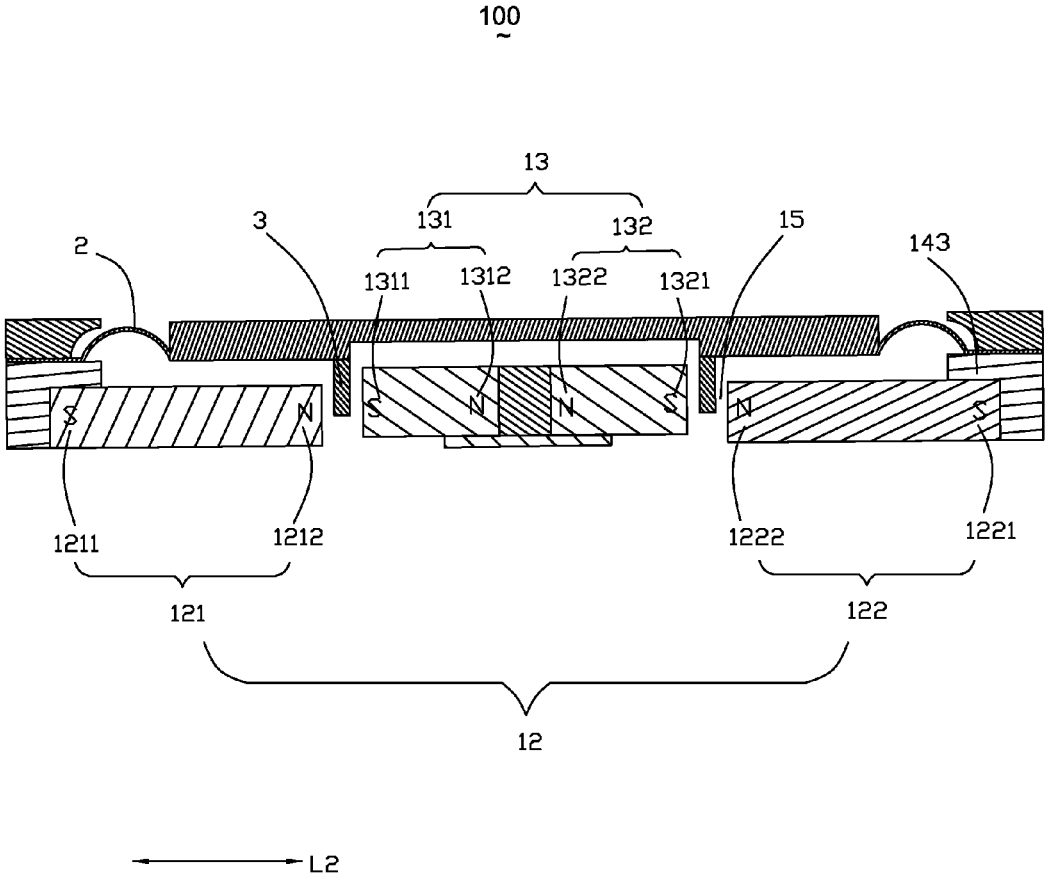
FIG. 3 is an enlarged cross-sectional view of the speaker taken along line III-III in FIG. 1.

Referring to FIGS. 1 to 3, each magnet 121, 122, 131, 132 defines a platy shape and has a longitudinal direction L1 and a lateral direction L2 perpendicular to the longitudinal direction L1. The magnets 121, 122, 131, 132 are disposed so that the magnetic fluxes 11 crosses the coil 3 at a substantially perpendicular angle, such as each of the magnets 121, 122, 131, 132 is parallel to each other in the longitudinal direction L1. The opposite poles of each magnet are arranged in the lateral direction. The second magnet 122 is disposed so that the fourth pole 1222 is closer to the second pole 1212 than the third pole 1221. The third magnet 131 is disposed so that the sixth pole 1312 opposes the eighth pole 1322 face to face and the fifth pole 1311 is closer to the second pole 1212 than the sixth pole 1312.

Figure 4:
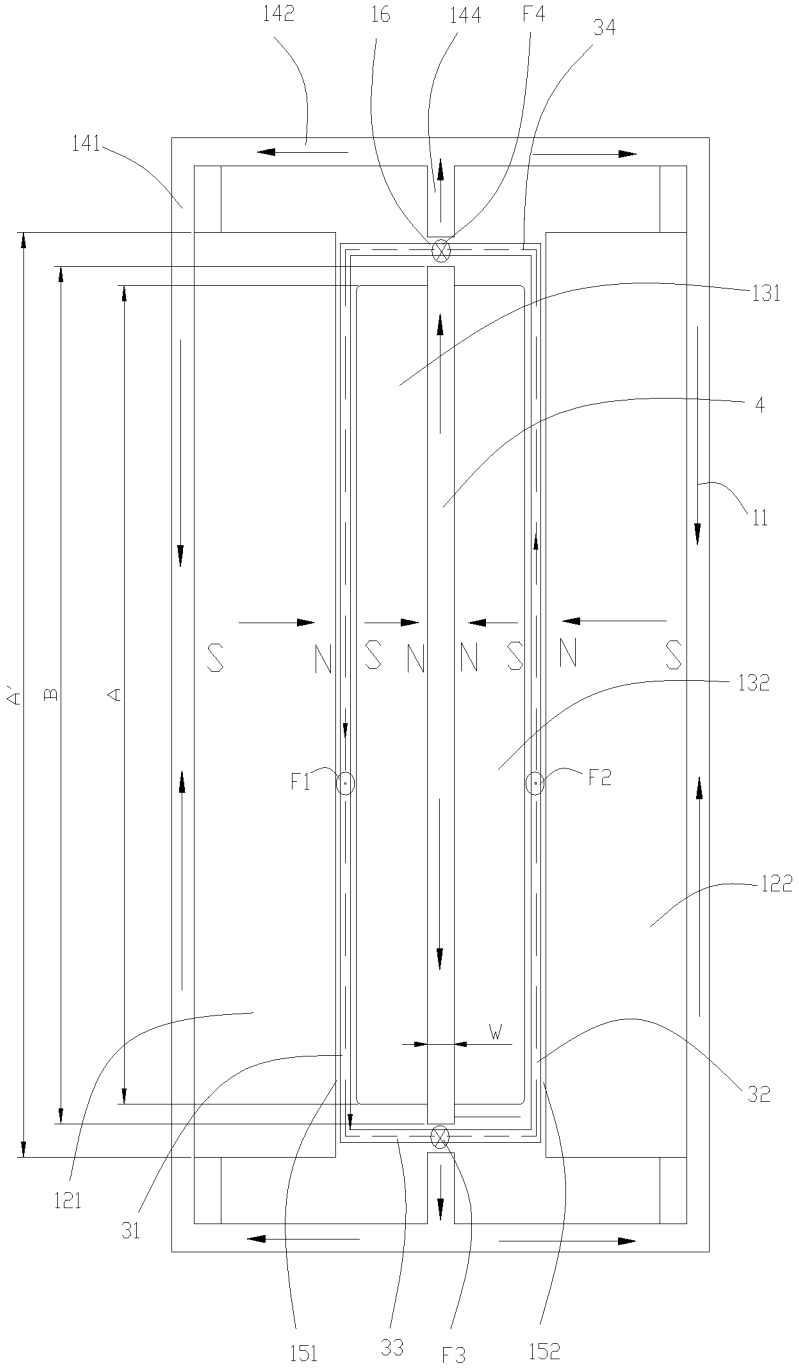
FIG. 4 is an illustrative top view of the speaker of the exemplary embodiment, a diaphragm, a frame and a plate thereof being removed away.

Referring to FIGS. 3 and 4, the first magnetic gap 15 defines a left first magnetic gap 151 and a right first magnetic gap 152. The left first magnetic gap 151 is formed between the second pole 1212 of the first magnet 121 and the fifth pole 1311 of the third magnet 131. The right first magnetic gap 152 is formed between the fourth pole 1222 of the second magnet 122 and the seventh pole 1321 of the fourth magnet 132.

Referring to FIGS. 3 and 4, the plate 5 is made of non-magnetic material and received into the receiving portions 145 of the yoke 14. A thickness of the inner magnet 13 is equal to that of the outer magnet 12. The magnetic conductive portion 4, at least a part of the third magnet 131, and at least a part of the fourth magnet 132 is supported by the plate 5. Thus, the outer and inner magnets 12 and 13 partly overlap in a direction of thickness. This arrangement provides speaker 100 with a thin and small size.

The magnetic conductive portion 4 has a platy shape. A length of the magnetic conductive portion B is not less than that of the inner magnet A for conducting the magnetic fluxes 11 effectively. A length of the outer magnet A' is not smaller than that of the inner magnet A. A width of the magnetic conductive portion W is unequal to the length of the inner and outer magnets A and A'. In the following descriptions, the width of the magnetic conductive portion W is smaller than the length of the inner magnet A.

The magnetic fluxes 11 generates from the second pole 1212, enters into the fifth pole 1311, comes out from the sixth pole 1312, flows along the magnetic conductive portion 4, flows through the pair of projecting portions 144, the pair of first sidewalls 142 and the pair of second sidewalls 141 of the yoke 14, and then enters into the first pole 1211. In another hands, the magnetic fluxes 11 generates from the fourth pole 1222, enters into the seventh pole 1321, comes out from the eighth pole 1322, flows along the magnetic conductive portion 4, flows through the pair of projecting portion 144, the pair of first sidewalls 142 and the pair of second sidewalls 141 of the yoke 14, and then enters into the third pole 1221. Thus, the magnetic fluxes 11 flow substantially perpendicularly to the coil 3.

The coil 3 receives current from external circuit. At one moment, direction of the current passing through the left first magnetic gap 151 is downward (shown as a dashed line with arrow). According to Left-hand rule, direction of the electromagnetic force F1 applied on a left half coil 31 is outward from the paper (labeled as ⊙), and direction of the electromagnetic force F2 applied on a right half coil 32 is also outward from the paper. However, direction of the electromagnetic force F3 applied on an upper half coil 34 is inward into the paper (labeled as ⊗), and direction of the electromagnetic force F4 applied on a lower half coil 33 is also inward into the paper. Because of the width of the magnetic conductive portion W is unequal to the length of the inner and outer magnets A and A', the total electromagnetic force effected on the coil 3 drives the coil 3 to move. In this description, because the width of the magnetic conductive portion W is smaller than the length of the inner magnet A, the total electromagnetic force drives the coil 3 to move outward from the paper. As direction and intensity of the current passing through the coil 3 is varied, the movement of the coil 3 is outward or inward, alternatively, which is called vibration.

Although the thickness of the inner and outer magnets 12 and 13 are equal to each other provided in this embodiment, the thickness of the inner and outer magnets is not limited that.

It is understood that in an alternative exemplary embodiment, the width of the magnetic conductive portion is larger than the length of the inner and outer magnets A and A'.

The opposite poles of each magnet are arranged in a lateral direction, thereby reducing the total height of the magnet assembly and the speaker.

While the present invention has been described with reference to the specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A magnet assembly for forming magnetic fluxes, comprising:

an outer magnet having a first magnet and a second magnet, the first magnet having a first pole and a second pole, a polarity of the second pole being opposite to that of the first pole, the second magnet having a third pole and a fourth pole, a polarity of the third pole being similar to that of the first pole, a polarity of the third pole being opposite to that of the fourth pole, the second magnet being disposed so that the fourth pole is closer to the second pole than the third pole;

an inner magnet surrounded by the outer magnet and having a third magnet and a fourth magnet, the third magnet having a fifth pole and a sixth pole, a polarity of the fifth pole being opposite to the second pole, a polarity of the sixth pole being opposite to that of the fifth pole, the fourth magnet having a seventh pole and an eighth pole, a polarity of the seventh pole being opposite to that of the fourth pole, a polarity of the eighth pole being opposite to the seventh pole, the third magnet being disposed so that the sixth pole opposes the eighth pole face to face and the fifth pole is closer to the second pole than the sixth pole;

a magnetic conductive portion sandwiched between the third and fourth magnets;

a yoke having a pair of first sidewalls and a pair of projecting portions extending from the pair of first sidewalls for cooperating with the magnetic conductive portion to form a second magnetic gap;

a first magnetic gap formed between an inner surface of the outer magnet and an outer surface of the inner magnet for generating a magnetic force;

wherein, the opposite poles of each magnet are arranged in a lateral direction and a width of the magnetic conductive portion is unequal to length of the inner and outer magnets.

2. The magnet assembly as described in claim 1, wherein a length of the magnetic conductive portion is not smaller than that of the inner magnet.

3. The magnet assembly as described in claim 2, wherein each magnet has a longitudinal direction and the magnets are parallel to each other in the longitudinal direction.

4. The magnet assembly as described in claim 1, wherein the yoke further has a fixing portion extending from one end of the sidewalls towards a center of the yoke for fixing the outer magnet firmly.

5. The magnet assembly as described in claim 3, wherein the outer and inner magnets partly overlap in a direction of thickness.

6. A speaker, comprising:

an outer magnet having a pair of first plate magnets;

an inner magnet surrounded by the outer magnet, the inner magnet having a pair of second plate magnets;

a yoke surrounding the outer magnet;

a first magnetic gap formed between an inner surface of the outer magnet and an outer surface of the inner magnet;

a magnetic conductive portion sandwiched between the pair of the second plate magnets, a width of the magnetic conductive portion being unequal to a length of each magnet;

wherein the yoke has a pair of first sidewalls and a pair of projecting portions extending from the pair of first sidewalls for cooperate with the magnetic conductive portion to form a second magnetic gap;

a plate made of non-magnetic material for supporting the magnetic conductive portion and at least a part of each second plate magnet;

a coil disposed in the first magnetic gap and; and a diaphragm supporting the coil and mounted on the yoke;

wherein, polarity of the pair of the first plate magnets adjacent to the magnetic gap is similar to each other;

polarity of the pair of the first plate magnets adjacent to the magnetic gap are opposite to that of the pair of the second plate magnets adjacent to the first magnetic gap; and the first magnetic gap is interacted with the coil for generating electromagnetic force to drive the coil to move.

7. The speaker as described in claim 6, wherein a length of the magnetic conductive portion is not smaller than that of the inner magnet.

8. The speaker as described in claim 7, wherein each magnet has a longitudinal direction and the magnets are parallel to each other in the longitudinal direction.

9. The speaker as described in claim 8, wherein the yoke further has a fixing portion extending from one end of the sidewalls towards a center of the yoke for fixing the outer magnet firmly.

10. The speaker as described in claim 8, wherein the outer and inner magnets partly overlap in a direction of thickness.

* * * * *